US009541360B2

(12) United States Patent
Moreno

(10) Patent No.: US 9,541,360 B2
(45) Date of Patent: Jan. 10, 2017

(54) WAD FOR CARTRIDGE

(71) Applicant: PLASTICOS HIDROSLUBLES, S.L., Rafelbuñol (ES)

(72) Inventor: Elena Moreno, Rafelbuñol (ES)

(73) Assignee: PLASTICOS HIDROSOLUBLES, S.L., Horteta (ES)

( * ) Notice: Subject to any disclaimer, the term of this patent is extended or adjusted under 35 U.S.C. 154(b) by 0 days.

(21) Appl. No.: 14/772,896

(22) PCT Filed: Jan. 10, 2014

(86) PCT No.: PCT/EP2014/050366
§ 371 (c)(1),
(2) Date: Sep. 4, 2015

(87) PCT Pub. No.: WO2014/135289
PCT Pub. Date: Sep. 12, 2014

(65) Prior Publication Data

US 2016/0010963 A1 Jan. 14, 2016

(30) Foreign Application Priority Data

Mar. 8, 2013 (EP) ..... 13382079

(51) Int. Cl.
*F42B 7/08* (2006.01)

(52) U.S. Cl.
CPC ..... *F42B 7/08* (2013.01)

(58) Field of Classification Search
CPC ..... F42B 7/08
USPC ..... 102/532
See application file for complete search history.

(56) References Cited

U.S. PATENT DOCUMENTS

| | | | | | |
|---|---|---|---|---|---|
| 3,827,363 | A * | 8/1974 | Curran | F42B 7/08 | 102/532 |
| 4,151,799 | A * | 5/1979 | Jackson | F42B 7/08 | 102/451 |
| 4,290,365 | A * | 9/1981 | Dreyer | F42B 5/28 | 102/449 |
| 5,263,417 | A * | 11/1993 | Godfrey-Phillips | F42B 7/08 | 102/453 |
| 5,798,152 | A * | 8/1998 | Stevens | B32B 27/08 | 264/514 |
| 2004/0099172 | A1 | 5/2004 | Schikora et al. | | |
| 2008/0223245 | A1* | 9/2008 | Stevens | F42B 7/08 | 102/453 |

FOREIGN PATENT DOCUMENTS

| | | |
|---|---|---|
| GB | 2 367 606 A | 4/2002 |
| GB | 2 422 150 A | 7/2006 |
| WO | 02/44644 A2 | 6/2002 |
| WO | 2006/075168 A2 | 7/2006 |

OTHER PUBLICATIONS

International Search Report for PCT/EP2014/050366 dated May 20, 2014 [PCT/ISA/210].
Written Opinion for PCT/EP2014/050366 dated May 20, 2014 [PCT/ISA/237].

* cited by examiner

*Primary Examiner* — Bret Hayes
(74) *Attorney, Agent, or Firm* — Sughrue Mion, PLLC

(57) ABSTRACT

A wad for cartridge, of the type comprising a pan to hold the ammo, connected by a bracket to a base of the wad, and manufactured by injection. The wad is a single piece of water-soluble plastic that is compostable, and has a moisture content by weight of between 2% and 10% after injection without the need for subsequent treatments. The plastic material has at least a mixture of more than one polymer resin, being at least one of them a poly-vinyl alcohol resin (PVA), and a plasticizer component.

6 Claims, No Drawings

WAD FOR CARTRIDGE

CROSS REFERENCE TO RELATED APPLICATIONS

This application is a National Stage of International Application No. PCT/EP2014/050366, filed on Jan. 10, 2014, which claims priority from European Patent Application No. 13382079.5, filed on Mar. 8, 2013, the contents of all of which are incorporated herein by reference in their entirety.

OBJECT OF THE INVENTION

The present invention, wad for cartridge, is related to a wad made of a water-soluble plastic and compostable material that after its manufacture by injection can be assembled without any type of subsequent preparation in a cartridge for its use with better conditions than those of a polyethylene wad.

The invention falls within the sector of ammunition, and particularly in the manufacture of wads for compostable and water-soluble plastic cartridges.

STATE OF THE ART

The cartridges are formed by a shell arranged on a brass head that includes a primer or firing pin at its bottom base. Inside the shell the gunpowder is arranged on the brass head and over this a wad with the charge or pellet. The wad in turn comprises two pans joined between which a flexible pillar is arranged such that the bottom pan is located on the gunpowder and the charge or pellets are inserted in the top pan.

The wad has as main mission to exploit to the maximum the exhaust gases produced in the combustion of the powder thanks to a perfect internal sealing of the cartridge at the time of the shooting, sealing the gas chamber and preventing the gasses from standing in the way of the pellet beam causing dispersions in said beam due to the gas. Likewise, it protects the pellets in their trajectory by the interior of the barrel of the gun preventing deformations of these by friction with the walls as well as at the moment of the explosion of the gunpowder. The flexible pillar helps soften the recoil of the gun by cushioning the initial impact that occurs at the moment of the shot. The wad is an essential component of the cartridge to achieve the ballistic regularity on pressures and speeds, such that the better the wad, the better the performance obtained from the cartridge.

There are and there have been different types of wads, from felt, cork or pressed paper, but the most common are the wads made of plastic, and mainly those manufactured by injection of low density polyethylene. Also, in the recent times there have been sought wads of biodegradable material that keep the conditions required from the wads, such as maximum pressure, speed and uniform ballistic qualities in the different conditions in which a shot might be made.

As it has been mentioned, the wads of biodegradable material used in hunting cartridges are known in the state of the art. However, none of said wads is, in addition to biodegradable, water-soluble and compostable. It must be understood as a biodegradable plastic the one in which the plastic material can break down or degrade in the chemical elements that form it, due to the action of biological agents, such as plants, animals, microorganisms and fungi, under natural environmental conditions. Likewise, it must be understood as compostable plastic a plastic undergoing biological degradation during the formation of compost to produce carbon dioxide, water, inorganic compounds and biomass, at a speed consistent with other compostable materials and leaves, without visually distinguishable waste or toxic waste. In short, a compostable plastic should also be biodegradable, while a biodegradable plastic need not be compostable. The compostability requires that the plastic is aerobically biodegraded at a speed similar to that of other compostable materials, that the waste are not distinguished (as plastics) and that they are not in turn toxic, while a biodegradable plastic simply has to biodegrade. In particular, for a material to be compostable 90% of its components must be biodegradable, so 10% of said components may not be biodegradable, but in no case can be harmful to the environment. The quality of the resulting compost, also a relevant factor, will depend on the harmfulness of these components which can be non-compostable and that make up this 10% of the material.

Likewise, it must be kept in mind that in addition to the chemical properties of the material that makes up the wad, so that the same can be considered compostable according to the current regulations (BS EN: 13432) the same should include sufficient mechanical properties to be used with assurances for its main purpose, which is to be fired without affecting the distance, strength, direction of the cartridge and scattering of the charge or pellets.

The international application number WO-2006/075168-A1 describes a biodegradable plastic wad the main characteristic of which is that after its injection manufacturing it must be subjected to a process of preparation prior to installation in a cartridge. On the other hand no wad is known in the state of the art that is compostable. In the above-mentioned international application, the material is dried prior to its injection, thus losing the mechanical properties of the water-soluble plastics, for subsequently, and once formed the wad with moisture content near zero, subjecting it to a high humidity environment at a high temperature to restore said mechanical properties by rehydrating the wad.

It must be kept in mind that the final properties of a wad depend both on the composition of the material that conforms it and on the method of manufacture to which it is subjected, and this has particular relevance when the material of the wad is water-soluble plastic. The application of the state of the art cited above comprises, e.g. and among other components, calcium carbonate or lime, which compound is soluble but non-biodegradable and never compostable. This compound dries out the product at the expense of the mechanical properties of the final product, since it takes away fluidity of the starting pellets for, after subjecting it to the injection method, obtaining the wad. The fact of taking away the fluidity of the pellets requires that in the manufacturing method it is necessary to increase the temperature, which degrades the polymer and makes its biodegradability, functionality and end use as wad unfeasible since the mechanical properties thereof will not comply with the minimum requirements demanded.

Likewise, among other components of the plastic material, described in the referenced application, zinc and titanium dioxide are cited, which in any case are considered positive in a compostable material.

The size of the wad is essential both for its installation in the shell of the cartridge and for the operation of the same, and for this reason it is important that the result of the method of injection for the obtainment of the wad, allows to obtain a product with certain dimensions and specific mechanical properties that should not be subjected to subsequent treatments that may affect mainly said properties. In the state of the art, the fact of degrading a material entails a loss of mechanical properties and it is not possible to give them back to the material, despite the fact that this is subjected to a process of preparation as described in application WO-2006/075168-A1. This process of preparation can perhaps provide the wad with the necessary dimensions for installation in the shell of the cartridge when being rehydrated, but in no case may it provide the wad with the mechanical properties necessary for its correct operation, by adding water in the product that do not provides it with the precise plastic features. In particular, if after the injection process is obtained a wad of small dimensions, it will not be possible to mount the same with assurances in the shell of a cartridge, since the gas will escape when firing the cartridge and it can affect the trajectory of the pellets as well as the pellets themselves. If on the contrary the wad is big, it will not be possible to mount the same in the shell of the cartridge since the outer diameter of the wad is greater than the inside diameter of the shell of the cartridge.

Application WO-2006/075168-A1, indicates that the moisture of the wad resulting from the injection process is less than 0.5% by weight, preferably 0%, and therefore is required to subject it to a moist environment after its injection such that its size varies, increasing, and at the same time trying to provide the wad with the precise mechanical properties for use. The fact that the product comes out of the injection process with low moisture content or zero moisture is due to the fact that during the process the material has been degraded, eliminating the water content to achieve a suitable fluidity for the injection of the pellets. The removal of this water content causes the degradation of the material with the consequences of this in terms of mechanical properties of the final product. For this reason, and following the obtainment of a wad with said moisture content, the same is subjected to moist environmental conditions, to try and give back the mechanical properties. By subjecting it to said moist conditions the wad absorbs the water from the environment increasing in size, but at the same time the material that makes up the wad is weakened when the water occupies the spaces between the components what directly affects the strength of the material. In addition to this, by forcing the water absorption, the material could have problems of excessive elasticity within the shell, which would imply an important risk for the user since it may cause the explosion inside the barrel due to the low strength and excessive deformation capacity. That is, the wad is not plasticized whereby it does not acquire plastic features which are the ones that enable its use as a wad with assurances. This increase in moisture causes that when using the wad at low temperatures the excess water freezes and when using it at high temperatures said excess water evaporates with the resulting problems for the operation of the cartridge, which results in a fragile material that does not withstand the compression forces required for the functionality of the wad and this can involve also a risk for the user. It is therefore an object of the present invention the obtainment of a cartridge not requiring re-hydration after its manufacture and in particular having a moisture content of at least 2%.

A possible indication that the material is degraded during the method described in the aforementioned patent application is that the composition of the same includes titanium dioxide, which is a white pigment. It is more than likely that said pigment is added to hide the actual colour of the product obtained after the injection and that the applicant believes that it must be yellow. This colour indicates that the material has degraded mechanically, and this degradation can be the result of problems with the formulation of the material composing the product or of subjecting the material to an excess of temperature during the injection process. This excess temperature produces cross-linking, i.e. the chains become rigid and insoluble, whereas when the formulation of the material is good the temperatures for processing should not be greater than 190°, which allows obtaining a final product with the appropriate mechanical properties.

In summary, the patent application WO-2006/075168-A1, includes compounds such as calcium carbonate, zinc, titanium dioxide, stearamide, which are drying compounds that absorb the water and cause that the pellets that are introduced into the extruder are hard and do not flow well through the extruder. In particular in the composition of the material are included lubricant components to increase the fluidity of the same and to be able to inject it, but this along with the typical characteristics of plastic greatly increases the fluidity of the same, and for this reason and to compensate said increase in fluidity the water content of the composition is eliminated thus reducing the fluidity, causing the degradation of the material in terms of mechanical properties for use as wad and achieving an extrudable compound but that is not homogeneous in its composition. For this reason, in said application there is an attempt for re-plasticizing (provide it with plastic properties again) the wad by subjecting it to an environment of 40° C. and 80% of moisture for one hour, however this measure fails to achieve a functional wad since the polymer chains had already been degraded and thus its mechanical properties, since it is not re-plasticized, but it is rehydrated.

An attempt has been made to locate a wad as the one described in the application WO-2006/075168 to test it and verify its mechanical properties, however, it has not been possible and failing this a low density polyethylene wad has been subjected to tensile testing with the purpose of knowing its elastic limit, which limit can be increased by the wad of the present invention for a better functioning of the wad. The tensile result of a sheet extracted from a wad of 32 g of polyethylene to study its elastic limit has been:

Tensile strength: 34.70 N +/−5.5 N

Elastic limit: 3.3% +/−1.1%

The low density polyethylene wads commonly used in the state of the art, and which are not in any case compostable with the consequent environmental risk associated with their use, mainly comprise as an element that is compressed at the time of the shooting the flexible pillar located between the pan and the base that acts as a spring, this element being the one that absorbs the axial force exerted on the wad when shooting the cartridge. However, in the wad object of the present invention, it is all the wad body, due to the mechanical properties of the plastic that forms it the one that absorbs all the force and not only the joining element between the pan and the base, what positively affects the direction of the trajectory and the output velocity of the cartridge from the weapon, as well as the lower scattering of the charge or pellets when reaching the aim.

Therefore, and in view of the above, for the obtainment of a usable cartridge, it is essential to control the composition of the pellets as well as the conditions of manufacture with the purpose of obtaining a wad having very well defined tolerances, both in relative humidity and in dimensions.

It is therefore an object of the present invention a wad for cartridge that is manufactured in a compostable plastic material for the protection of the environment and that in turn has elasticity greater than that of a low density polyethylene cartridge.

DESCRIPTION OF THE INVENTION

With the purpose of solving the problems existing in the state of the art, and obtaining a wad that is water-soluble and compostable with optimal mechanical properties for use, the present invention has as an object a wad according to claim 1.

In particular, the wad object of the present invention comprises, like the other wads of the state of the art three distinct parts, a top pan where the ammunition or pellets will be arranged, a base or bottom pan, which serves as gas barrier and a support or pillar that joins both pans.

On the other hand, the wad of the present invention is made of a water-soluble plastic and compostable material, implying the absence of toxic or harmful components to the environment, such as calcium carbonate, zinc, titanium dioxide or stearamide, allowing that the same, in addition to biodegrade can become compost since it does not include toxic materials often present in biodegradable plastics. As mentioned above, an example of said components that are not present in the plastic material object of the present invention is calcium carbonate that dissolves but it is not compostable.

To achieve said result, and at the same time maintaining and even improving the mechanical properties of the wads of the state of the art, whether these are made of biodegradable material or polyethylene, pellets comprising a mixture of at least two polymeric resins, at least one of them being poly-vinyl alcohol (PVA) resin, are used as water-soluble plastic material and comprising in addition at least one plasticizer component and preferably one or more additives.

Through the combination of more than one polymer resin, at least one of them being PVA, and both resins having different molecular weight and different degree of hydrolysis, it is achieved that when combining the properties of both resins, the resulting product has greater resistance and more stable properties for the forming process of the wad, as well as a greater fluidity of the pellets for their injection without material degradation, therefore obtaining final mechanical properties of the wad optimal for use.

The at least one PVA resin with molecular weight that provides mechanical resistance to the final plastic material, and the at least another polymer resin, with different molecular weight that provides fluidity and stability to said material during the manufacturing process. In this combination of resins the PVA resin can have a higher molecular weight than the at least another resin, or the other way around.

The polymer resin that is not PVA, can be chosen from starch, cellulose, polyethylene, nylon, polypropylene, PVA, polystyrene, polyester, polycarbonate, polysulfone, among others.

Likewise, the composition comprises a plasticizer the function of which is in addition to making the composition plastic, to reduce the melting temperature of the same. Glycerine is preferably used as plasticizer.

Also different additives can be added to the mixture. Examples of these additives can be lubricants, absorbents, etc.

The composition of said plastic material comprises:

Between 40 and 90% of a mixture of more than one polymer resin, being at least one of them a poly-vinyl alcohol resin (PVA), Between 10 and 60% of a plasticizer, and Between 0 and 20% of additives.

The objective of the previous plastic material is to obtain pellets with a fluidity that is sufficient for the injection, which varies between 4 and 18 (g/10 min, according to ISO 1133), without degrading the material and achieving a product after the injection in an injection moulding machine, and without the need for subsequent treatments, therefore immediately after the injection process or immediately after leaving the injection moulding machine, with a moisture greater than 2% and less than 10% by weight to ensure that the elastic properties of the final product are kept above those of a low density polyethylene wad. In particular, the tensile result of a sheet extracted from a wad of 32 g object of the present invention must give a result higher than 45N and an elastic limit higher than 5%.

The manufacturing method of the wad object of the present invention consists of the manufacture of a chip made of water-soluble plastic material for which the plastic components mentioned above are mixed and then are introduced into an extruder for obtaining the material that is cut to obtain the pellets of material.

Subsequently said pellets are subjected to a process of injection, in an injection moulding machine, immediately after said process, which the wad object of the present invention is obtained.

This composition allows obtaining a wad that is water-soluble and compostable, since it does not include in its composition any components that may be harmful or toxic to the environment, and complying with the requirement that at least 90% of its composition is compostable.

It is essential that the wad has a moisture content within a well defined range and that allows its installation in the cartridge without the need for subsequent treatments, i.e., that after the injection of the material from the pellets, the wad is ready for use and introduction in the shell of the cartridge. The wad object of the present invention has a moisture content between 2% and 10% by weight after the injection process, that is to say, immediately after the injection process, and immediately after the wad leaves the injection moulding machine.

Likewise, it is very important to control the dimensions of the final product, with walls of more than 150 microns of thickness, and preferably between 1 mm and 1.5 mm of thickness, such that the outer diameter of the pan of the wad once injected has a tolerance of between 0% and 1.2%. If the final product exceeds said tolerances it would not be able to be installed in the cartridge since it cannot be inserted into the shell of the same.

DESCRIPTION OF PREFERRED EMBODIMENT

In particular, one example of the invention object the present application is based on the manufacture by extrusion of composite plastic material pellets (expressed in % by weight of the total) of:

Between 40 and 90% of a mixture of more than one polymer resin, being at least one of them a poly-vinyl alcohol resin (PVA), Between 10 and 60% of a plasticizer, and Between 0 and 20% of additives.

For example, compositions (expressed in % by weight of the total) of said compostable and water-soluble plastic material may be:

| Material | Mixture of resin | Plasticizer | Additive |
|---|---|---|---|
| A | 40% | 40% | 20% |
| B | 75% | 20% | 5% |
| C | 90% | 10% | 0% |

The mixture of polymeric resins comprises at least one resin of polyvinyl alcohol (PVA) and at least another polymer resin the mix of which allows achieving the necessary fluidity for a correct plastic injection and extrusion during its manufacture without the need for degrading the material to achieve said fluidity.

The mixture of resins may comprise, for example:

A PVA resin with molecular weight, degree of hydrolysis and viscosity that provide the necessary strength and elasticity to the final product, A polymer resin with molecular weight, degree of hydrolysis and viscosity that provide the necessary strength and elasticity to the final product. The properties of this should complement those of the previous resin.

In addition to the above, other polymers such as those described above may be used.

Through the combination of both resins the combination of the properties of both is achieved, obtaining a resulting resin which has optimum strength and stability for the forming process of the wad, as well as a fluidity of the pellets, which varies between 4 and 18, preferably less than 15, suitable for its injection without degradation of the material.

In addition to the resin, the plastic material has a plasticizer, preferably glycerine, although others that are appropriate for the object of the present invention can be used.

The composition is completed with additives depending on different characteristics that the wad must have.

In the previous examples, the compositions (expressed in % by weight of the total) of the different materials are:

| Material | PVA Resin | Other resin | Plasticizer/s | Additive/s |
|---|---|---|---|---|
| A | 40% | 40% | 15% | 5% |
| B | 70% | 10% | 10% | 10% |
| C | 19% | 50% | 30% | 1% |

With these components a compostable and water-soluble plastic is ensured, since it does not include any that can be toxic or harmful to the environment.

Once the mixture has been prepared, the same is extruded and cut for obtaining the pellets, which once injected, and without the need for subsequent treatments after the injection process, provides the product object of the present invention, i.e. a wad.

The wad has the common parts of the low density polyethylene wads, such as a top pan, a support and a base or bottom pan. Said wad is then introduced into a shell with the powder and pellets or charge for forming the cartridge.

The wad obtained, with walls with a thickness greater than 150 microns and preferably of between 1 and 1.5 mm, has a moisture content by weight of between 2% and 10% and a tensile strength higher than 50 N and elastic limit greater than 5. Likewise, the tolerance of the outer diameter of the pan of the wad once injected is of between 0% and 1.2% to ensure its correct installation in the shell of the cartridge.

In particular, for a wad of dimensions of 28 g, the following values were obtained from the above mentioned materials:

| Material | Moisture (% with respect to the total) | Tensile Strength |
|---|---|---|
| A | 3% | 52.9N ± 7.1N and 7.5% ± 1.0% |
| B | 5% | 51.8N ± 7.1N and 7.3% ± 1.0% |
| C | 7% | 52.3N ± 7.1N and 7.45% ± 1.0% |

In view of the above, the wads object of the present patent application, have elastic and mechanical features that improve those of the wads in the state of the art, in particular those of low density polyethylene, while meeting the requirements of compostability and water solubility.

The invention claimed is:

1. A wad for cartridge, immediately following formation by injection to have a pan to hold ammo connected by a bracket to a base of the wad, the wad comprising:

a single piece of material that is a water-soluble plastic and compostable, said material comprising:

a mixture of at least two polymeric resins, at least one of the polymer resins being poly-vinyl alcohol (PVA) resin, and a plasticizer component; and wherein a moisture content of the wad immediately following formation by injection and without further treatment is between 2% and 10% by weight.

2. The wad, according to claim 1, wherein walls of the wad have a thickness of between 0.8 and 1.5 mm.

3. The wad, according to claim 1, wherein said material comprises additives.

4. The wad, according to claim 1, comprising, by weight:

between 40 and 90% of the mixture of the at least two polymer resins, between 10 and 60% of a plasticizer, and between 0 and 20% of additives.

5. The wad, according to claim 1, wherein an outer diameter of the pan of the wad has a tolerance after the injection of between 0% and 1.2%.

6. The wad, according to claim 1, comprising a tensile strength higher than 50 N and an elastic limit of more than 5%.

* * * * *